US008517220B2

(12) United States Patent
Julia et al.

(10) Patent No.: US 8,517,220 B2
(45) Date of Patent: Aug. 27, 2013

(54) FLUID DISPENSING DEVICE INCLUDING A PUMP

(75) Inventors: Xavier Julia, Villefontaine (FR); Gaetan Painchaud, Francheville (FR); Julien Brand, Saint Clair de la Tour (FR); Gilles Besoin, La Tour du Pain (FR)

(73) Assignee: Rexam Healthcare La Verpilliere (FR)

( * ) Notice: Subject to any disclaimer, the term of this patent is extended or adjusted under 35 U.S.C. 154(b) by 277 days.

(21) Appl. No.: 12/891,412

(22) Filed: Sep. 27, 2010

(65) Prior Publication Data

US 2011/0062186 A1 Mar. 17, 2011

Related U.S. Application Data

(63) Continuation of application No. PCT/FR2009/000358, filed on Mar. 27, 2009.

(30) Foreign Application Priority Data

Mar. 27, 2008 (FR) ..... 08 51996

(51) Int. Cl.
*B67B 1/00* (2006.01)
*B67D 7/84* (2010.01)
*B67D 7/30* (2010.01)

(52) U.S. Cl.
USPC ..... 222/153.04; 222/183; 222/321.8

(58) Field of Classification Search
USPC ..... 222/153.04, 173, 175, 251, 384, 222/383.1, 628, 323, 324, 372, 378, 381, 222/319, 325, 326, 182, 183, 21, 162, 321.8
See application file for complete search history.

(56) References Cited

U.S. PATENT DOCUMENTS 4,174,056 A * 11/1979 Loeffler ..... 222/321.8
5,038,964 A * 8/1991 Bouix ..... 222/153.04
7,726,519 B2 * 6/2010 Heldt et al. ..... 222/153.13

(Continued)

FOREIGN PATENT DOCUMENTS

FR 2637870 A1 4/1990
FR 2812826 A1 2/2002
FR 2882349 A1 8/2006
FR 2889691 A1 2/2007
JP 0457264 U 5/1992
WO 8910881 A1 11/1989

OTHER PUBLICATIONS

French Search Report; Application No. FR 0851996; Oct. 28, 2008; 6 pages.

(Continued)

*Primary Examiner* — Kevin P Shaver
*Assistant Examiner* — Michael Melaragno
(74) *Attorney, Agent, or Firm* — St. Onge Steward Johnston & Reens LLC

(57) ABSTRACT

A fluid dispenser device including a pump for dispensing the fluid; a first arm referred to as the "main" arm, mounted to pivot on the device about an axis referred to as the "main" axis, which arm has a press zone on which the user exerts pressure in order to actuate the pump; and a second arm, referred to as the "intermediate" arm, mounted to pivot on the main arm about an axis, referred to as the "intermediate" axis, this axis being disposed on the main arm between the press zone and the main axis, and the intermediate arm being configured to transmit the movement of the press zone to the pump.

8 Claims, 2 Drawing Sheets

(56) References Cited

U.S. PATENT DOCUMENTS

| | | | | |
|---|---|---|---|---|
| 7,984,830 | B2 * | 7/2011 | Stradella | 222/153.13 |
| 2007/0095853 | A1 * | 5/2007 | Bonney et al. | 222/21 |
| 2007/0164049 | A1 * | 7/2007 | Bonney et al. | 222/162 |
| 2008/0116223 | A1 * | 5/2008 | Stradella | 222/162 |
| 2009/0140011 | A1 * | 6/2009 | Olson et al. | 222/380 |
| 2010/0308082 | A1 * | 12/2010 | Lamble et al. | 222/162 |

OTHER PUBLICATIONS

International Preliminary Report on Patentability and Written Opinion of the International Searching Authority; PCT/FR2009/000358; Nov. 2, 2010; 5 pages.

International Search Report; PCT/FR2009/000358; Oct. 15, 2009; 3 pages.

* cited by examiner

FLUID DISPENSING DEVICE INCLUDING A PUMP

CROSS-REFERENCE TO RELATED APPLICATIONS

The present application is a continuation of pending International patent application PCT/FR2009/000358 filed Mar. 27, 2009, which designates the United States and claims priority from French patent application FR 0851996 filed Mar. 27, 2008, the content of which is incorporated herein by reference.

FIELD OF THE INVENTION

The present invention relates to the field of dispensing fluid by means of a pump. More particularly, but not exclusively, the device makes it possible to dispense a liquid for nose, eye, or mouth use, the user actuating the pump by exerting pressure laterally on the device.

BACKGROUND OF THE INVENTION

Laterally-actuated spray devices are already known, such as the device described in Document FR 2 812 826. That device comprises a pump that is movable axially between a rest position and a liquid-dispensing position. That pump is caused to move by an actuating arm that is mounted to pivot on the device in such a manner as to move the pump into the dispensing position when the user presses the arm in the transverse direction.

The force that the user's hand must exert on the actuating arm can be relatively high, which makes the device awkward and difficult to use for elderly people or for children.

SUMMARY OF THE INVENTION

The present invention proposes to reduce the force necessary for actuating the device.

To this end, the invention provides a fluid dispenser device for dispensing fluid, said fluid dispenser device comprising: a pump for dispensing the fluid; a first arm referred to as the "main" arm, mounted to pivot on the device about an axis referred to as the "main" axis, which arm is provided with a press zone on which the user exerts pressure in order to actuate the pump; and a second arm, referred to as the "intermediate" arm, mounted to pivot on the main arm about an axis, referred to as the "intermediate" axis, this axis being disposed on the main arm between the press zone and the main axis, and the intermediate arm being configured to transmit the movement of the press zone to the pump.

Thus, the intermediate arm, mounted between the pivot axis and the press zone of the main arm, can generate a lever effect that makes it possible to reduce the force that needs to be exerted by the user on the press zone for the purpose of actuating the pump. In addition, since this lever is mounted to pivot on the main arm, the angular position of the intermediate arm relative to the main arm can vary while the main arm is pivoting. As a result, the free end of the intermediate arm, which end is opposite from the pivot axis of the intermediate arm, can move in translation in a direction corresponding to the axis of the pump, making it possible to move the pump into its dispensing position. In other words, by means of the proposed configuration, the free end of the intermediate arm does not necessarily move in rotation, it can advantageously move in translation, so that the movement in rotation generated by the user pressing on the main arm is transformed into a movement in translation of the free end of the intermediate arm, this movement in translation taking place in the axial direction (i.e. along the axis of the pump), so as to actuate the pump. By means of this movement in axial translation, a force exerted by the user on the press zone makes it possible to move the pump (or a support of the pump) over a longer stroke than if the intermediate arm were prevented from moving relative to the main arm, in which case the free end of the intermediate arm would move in rotation. In conclusion, by means of the pivotally-mounted intermediate arm, the user can exert a lower force for actuating the pump than when the dispenser device has a single pivotally-mounted arm actuating the pump directly.

Among the advantages of the dispenser device, it can be understood that it enables the user to exert a lower force on the press zone, or indeed, for the same force exerted by the user, to exert a higher force on the pump and thus to use a pump having a higher activation force, so as to achieve specific features, e.g. certain spray qualities. Or indeed, for the same pump, the above device can require the press zone to be moved to a smaller extent, thereby making it possible to increase the overall compactness of the device, in particular by reducing the inclination of the main arm relative to the general shape of the device, and thus by reducing the general diameter of the device.

It can be understood below that the term "movement" as applied to the pump is used to designate movement of the entire pump or of some portion thereof. Generally, the pump comprises an upstream portion and a downstream portion that are mounted to move relative to each other by sliding, and movement of the pump corresponds to movement of the upstream portion relative to the downstream portion.

The device may also have one or more of the following characteristics:

The device has two ends, namely a dispensing head and an end-wall, the main axis being provided in the vicinity of one of the ends and the press zone being provided in the vicinity of the opposite end. By means of this configuration, the press zone on which the user exerts pressure is as far away as possible from the pivot axis of the main arm, thereby optimizing the lever effect, and thus reducing to as small as possible the force that needs to be exerted on the press zone.

The intermediate arm has a free end opposite from its pivot axis, this free end co-operating with an abutment constrained to move with the pump, the abutment being arranged in such a manner that the pivoting of the intermediate arm causes the pump to be moved into a fluid-dispensing position. It can be understood that an abutment constrained to move with the pump moves with the pump. It can be provided directly on a portion of the pump or on a part fastened to the pump, e.g. on a link ring interconnecting the pump and the container of the device, or indeed on the container mounted such that it is prevented from moving relative to another portion of the pump.

The intermediate axis is mounted on the main arm at a distance relative to the main axis that is less than two-thirds of the distance between the main axis and the press zone. In this configuration, the effect brought by the intermediate arm is optimized. In particular, the stroke of the free end of the intermediate arm is sufficiently long in the axial direction, and the distance between the press zone and the intermediate axis is also sufficiently large to achieve a satisfactory reduction in the force to be exerted by the user. In order to minimize this force, the intermediate axis is mounted on the main arm as close as possible to the main axis, preferably at a distance relative to the main axis that is less than one half of the distance between the main axis and the press zone. It should, however, be noted that, for optimum operation of the device, the position of the intermediate axis on the main arm is not the only parameter to be taken into account, it being possible for the reduction in the force exerted by the user to depend, for example, on the inclination of the intermediate arm relative to the axis of the pump, or indeed to depend on other parameters.

The device is provided with declutching means in such a manner that the pressure exerted by the user causes the pump to return to its rest position after said pump has moved into a dispensing position. Thus, it is not the press zone being released by the user that causes the pump to return to the rest position, but rather it is the final stage of the pressing exerted by the user. This characteristic is particularly advantageous because it guarantees that the pump returns to the rest position, automatically and directly after a metered quantity of fluid has been dispensed, and not after a certain lapse of time, simultaneously with the press zone being released by the user. It is thus possible to guarantee that the pump returns to the rest position when the device is in the dispensing configuration, in particular when it is disposed head-down, and thus when the fluid contained in the container is to be found beside the pump. As a result, when the pump goes from its dispensing position to its rest position, the liquid is to be found beside the pump, which thus sucks in liquid, rather than air contained in the container and that might de-prime the pump.

The declutching means comprise an abutment past which the intermediate arm forces its way once the pump is in the dispensing position.

The device further comprises a dispenser head and can take up a "head-up" position or a "head-down" position, the device being designed to dispense liquid when it is in the head-down position, the device being provided with disabling means for disabling the device when it is in the head-up position. For the same reasons as above, these disabling means prevent the pump from de-priming, in the event that the user is tempted to press on the press zone while the device is in the head-up position.

It should be noted that the head-down position generally corresponds to a position in which the dispenser head is below the container in the direction of gravity.

The disabling means comprise a ball that can take up a disabling position and that, under the effect of gravity, can take up an enabling position.

The axis of the main arm is disposed in the vicinity of the dispenser head of the device.

The axis of the main arm is disposed in the vicinity of the end-wall of the device.

BRIEF DESCRIPTION OF THE DRAWINGS

The invention can be better understood on reading the following description given merely by way of example, and with reference to the drawings, in which.

DETAILED DESCRIPTION OF THE INVENTION

Figure 1:
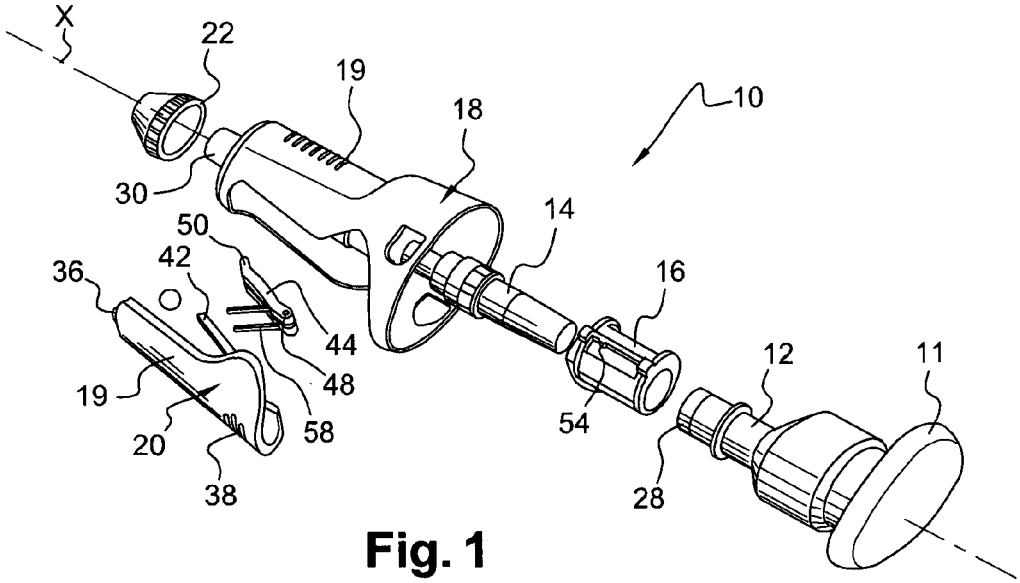
FIG. 1 is an exploded perspective view of an embodiment of a fluid dispenser device.

FIG. 1 shows a device 10 for dispensing fluid, and more particularly for dispensing predetermined metered quantities or "doses" of liquid for nose, eye, or mouth use. The device 10 has an end-wall 11, a container 12 for containing the liquid, a pump 14 connected to the container 12 via a link ring 16, an outer casing 18, provided with a graspable zone 19, a pivotally-mounted main arm 20, and a cap 22.

The pump 14 makes it possible to suck in the liquid contained in the container 12 in order to deliver it from the device, e.g. by spraying. To this end, the pump 14 comprises two portions that are mounted to slide relative to each other, namely, in this example, an upstream portion 24 and a downstream portion 26, shown in FIG. 2. The portions 24 and 26 are mounted to slide along the longitudinal axis X of the pump between a rest position, shown in FIG. 2, and a dispensing position, in which the upstream portion 24 is in end-of-stroke abutment against the downstream portion 26, the movement of the portion 24 having made it possible to suck in the liquid contained in the container 12. The pump going from the rest position to the dispensing position corresponds to said pump being actuated.

The downstream portion 26 of the pump has a "dispensing" end 27. In this example, the spray direction of the device 10 is axial, and thus along the axis X. The dispensing end 27 is therefore provided with an orifice of axis X in its top surface, for the purpose of directing the liquid along the axis X. It can be understood that other fluid dispensing directions are possible.

The pump 14 is mounted on the container 12 via the link ring 16 that is constrained to move with the upstream portion 24 of the pump 14. Said link ring 16 therefore moves with the upstream portion 24 of the pump while said pump is taking up its dispensing position. In addition, the ring 16 is mounted on the container 12 in such a manner as to be prevented from moving relative thereto, e.g. by snap-fastening, so that the container can move with the ring and with the upstream portion 24 of the pump. Said ring 16 is tubular in general shape, and is mounted coaxially around the upstream portion 24 of the pump, e.g. by snap-fastening. The ring 16 co-operates with the upstream portion 24 of the pump to define a tubular recess designed to receive an outlet segment 28 of the container 12.

The outer casing 18 is cylindrical or conical in general shape. It carries a fluid dispenser head 30 that receives the dispensing end 27 of the pump 14. The head 30 is provided with an orifice 32, extending the orifice in the end 27. At the end opposite from the head 30, the end-wall 11 is mounted on the casing 18, e.g. by snap-fastening.

Figure 2:
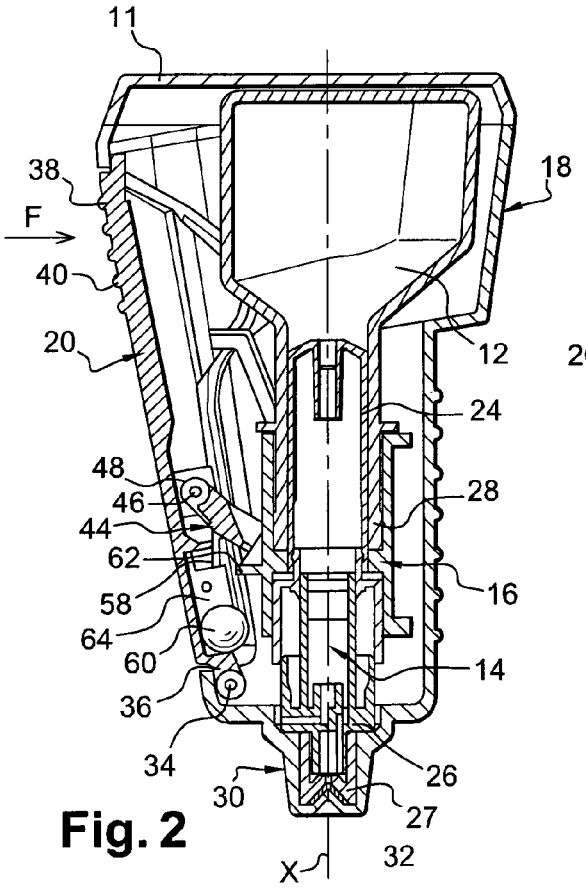
FIG. 2 is a longitudinal section view of the device of FIG. 1.

The device 10 is a laterally actuated device, i.e. the user exerts pressure in the direction indicated by arrow F in FIG. 2, i.e. substantially in a transverse direction that is perpendicular to the axis X, in order to dispense fluid.

To this end, the arm 20 constitutes a first arm that is referred to below as the "main" arm, and that is pivotally-mounted on the device 10, and more precisely on the casing 18, to pivot about a pivot axis 34, referred to below as the "main" axis 34, and represented by the letter 0 in FIG. 4. For example, the axis 34 is formed by means of studs provided in the casing 18 and co-operating with orifices provided in one end 36 of the arm 20, which end is referred to below as the "captive" end of the arm 20. The arm 20 also has a "free" end 38 that is disposed opposite from the captive end 36. In the vicinity of said free end 38, the arm 20 is provided with a press zone 40 that is designed to be pressed by the user for the purpose of actuating the pump. It should be noted that the user can press on the zone 40 either directly, i.e. with the skin of the user being in contact with the press zone 40, or indirectly, i.e. with an element disposed between the skin of the user and the press zone 40, but with the pressing movement made by the user being transmitted to the press zone 40. The press zone 40 is represented by the point B in FIG. 4. The arm 20 is mounted to pivot between a rest position and at least one pressed position. In this example, the main arm 20 is mounted to pivot between the rest position, shown in FIGS. 2 and 3 and a pushed-in position, in which the arm 20 is pushed in to the maximum extent inside the device 10. Between the rest position and the pushed-in position, the arm 20 can take up a declutching intermediate position that is described below.

The main arm 20 is also provided with return means 42, making it possible to urge the arm 20 back into its rest position when the user ceases to press on the press zone 40. For example, these return means 42 comprise a resilient tongue.

In addition to having the main arm 20, the device 10 has a second arm 44, referred to below as the "intermediate" arm 44, that is mounted to pivot on the main arm 20 about an axis 46 referred to below as the "intermediate" axis and represented by the point A in FIG. 4. The axis 46 is formed at a first end 48 of the arm 44 that is referred to below as the "captive" end. The intermediate arm 44 has a second end 50 that is opposite from the end 48, and that is referred to below as the "free" end 50. This end 50 is provided with an abutment surface 52 arranged to co-operate with an abutment 54 that is constrained to move with the pump 14. More precisely, the abutment 54 is provided on the link ring 16 that is constrained to move with the upstream portion 24 of the pump 14. In this example, said abutment 54 is in the form of a protuberance provided in a groove 56 extending in the axial direction, and projecting from the outside surface of the ring 16. More precisely, the protuberance 54 is in the form of a bead. It may also have a beveled surface that is configured so that the abutment 52 of the intermediate arm 44 can, in a first stage, be in abutment, and, in a second stage, force its way past the protuberance 54. As described below, the abutment 52 co-operates with the abutment 54 so that the pivoting of the intermediate arm 44 drives the movement of the abutment 54, therefore of the upstream portion 24 of the pump 14, along the axial direction X, and so that the abutment 52 forces its way past the abutment 54 at the end of the stroke of the portion 24, once the user has pushed in the press zone 40 to the fullest extent. Thus, the means 52, 54 are means for actuating the pump 14, and also, in this example, means for declutching the device 16.

The intermediate arm 44 is also provided with return means 58, e.g. a resilient arm 58, arranged to urge the intermediate arm 44 back into the rest position after the pump has been actuated.

Figure 4:
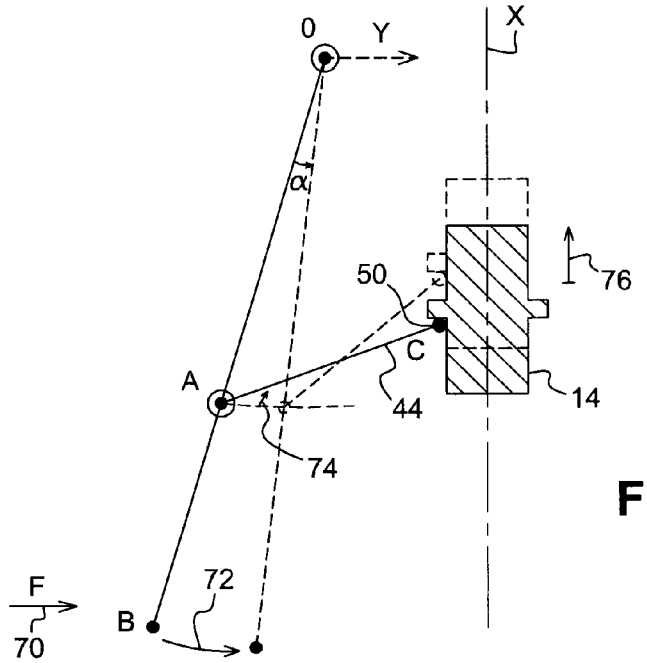
FIG. 4 is a diagrammatic view showing how the device of FIG. 1 operates.

As can be seen in FIG. 4, the axis 46 of the intermediate arm 44 is disposed on the main arm 20 at a distance OA relative to the main axis 34 that is less than two-thirds of the distance OB between the main axis 34 and the press zone 40. Generally, in order to have a satisfactory lever effect, the distance OA is less than or equal to the distance AB.

It should be noted that, in this embodiment, the main axis 34 is provided in the vicinity of one end of the device 10, namely in the vicinity of the dispenser head 30, and the press zone 40 is provided in the vicinity of the opposite end of the device 10, namely in the vicinity of the end-wall 11 of the device. Therefore, the distance between the axis 34 and the press zone 40 is as large as possible on the device 10.

In addition, in this embodiment, the device 10 is provided with means for disabling the device when said device 10 is in the head-up position. The head-up position corresponds to a position in which the dispenser head 30 is above the end-wall 11 in the direction of gravity, indicated by arrow g in FIG. 5. This head-up position corresponds to a storage position for the device 10, in which position the end-wall 11 is generally stood on a support surface. The device 10 take up an upside-down position relative to this head-up position, namely a head-down position, shown in FIG. 2, in which position the dispenser head 30 is disposed below the end-wall 11. In this head-down position, the liquid contained in the container 12 is situated in the downstream portion of the container 12, under the effect of gravity, and in particular in the vicinity of the outlet segment 28. The disabling means for disabling the pump 14 when the device is in the head-up position make it possible to actuate the pump only when it is in the head-down position, so as to avoid any de-priming of the pump that might take place by air being sucked in, because the liquid is situated in the upstream portion of the container 12 and air is thus situated in the downstream portion, beside the outlet segment 28. In this example, the disabling means of the device comprise a disabling ball 60 mounted to move in a recess 64 in the arm 20, the recess 64 being defined in particular by a projection 66 formed on the inside surface of the arm 20. The ball 60 is mounted to move between a disabling position, shown in FIG. 5, and an enabling position, shown in FIG. 2. In the disabling position, the ball 60 is interposed between the link arm 20 and disabling means 62 formed on the link ring 16, and more precisely between the arm 20 and a projection 62 formed on the outside wall of the ring 16. In the enabling position, the ball 60 no longer co-operates with the projection 62, so that the main arm 20 is free to move relative to the link ring 16.

Operation of the device 10 is described below.

Figure 3:
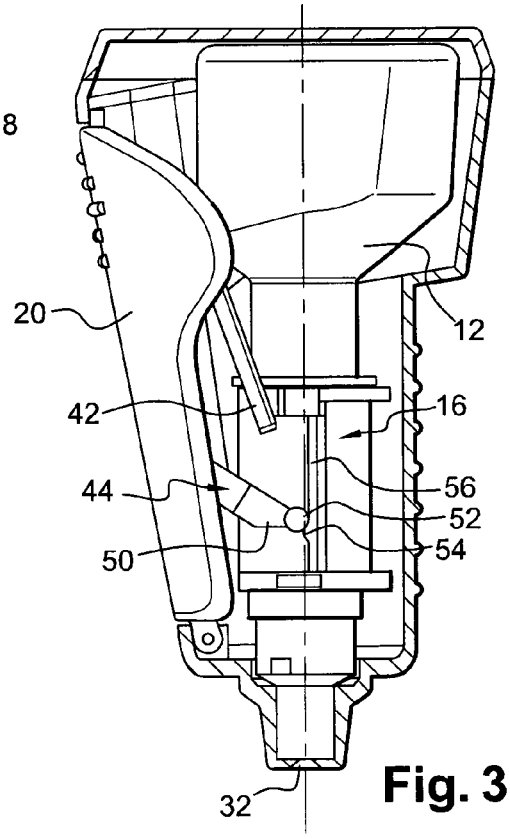
FIG. 3 is a view similar to FIG. 2, with some of the elements not being in section.
Figure 5:
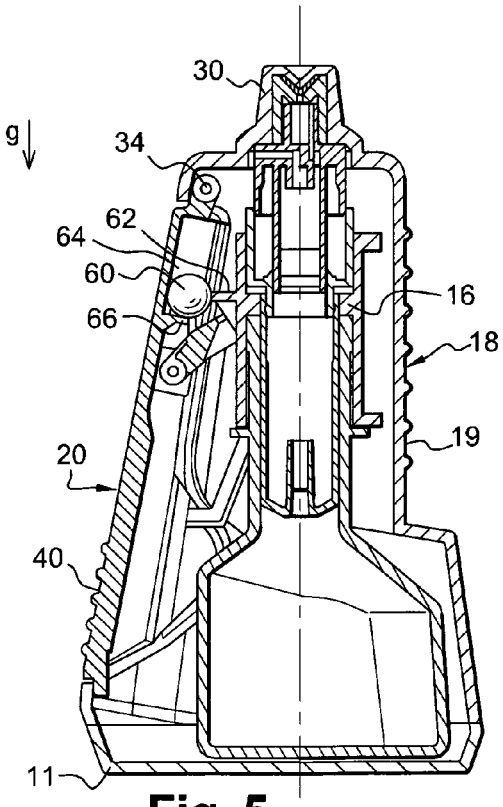
FIG. 5 is a view analogous to FIG. 2, the device being shown in the head-up position.

While the device 10 is not being used, e.g. while it is standing on any support, without the user pressing on it, the device is in the configuration shown in FIG. 5, in the head-up position. In this position, the ball 60 is in the disabling position in the recess 64, interposed between the arm 20 and the projection 62 on the ring 16, so that it is not possible to push in the arm 40 and thus to actuate the pump 14. When the user wishes to use the device 10, said user takes hold of the device by means of the graspable zone 19, preferably by wrapping the hand around the casing 18, in particular around the press zone 40. In order to dispense a predetermined metered quantity of fluid, the user puts the device 10 into the head-down position, shown in FIG. 2. Due to this head-down position, the ball 60 rolls inside the recess 64, under the effect of gravity, and thus goes from its disabling position to its enabling position. In this position, the projection 62 no longer prevents the main arm 20 from pivoting. Once the device 10 is in the head-down position, the user can press on the press zone 40, thereby causing the main arm 20 to pivot about its axis 34, so that it takes up a position as shown in dashed lines in FIG. 4. Thus, the pressing movement F by the user, illustrated by arrow 70, generates a movement in rotation of the main arm 20 about the main axis 34, through an angle $\alpha$ (alpha), this movement in rotation being illustrated by arrow 72. This movement in rotation of the main arm 20 relative to the casing 18 causes the intermediate arm 44 to move in rotation relative to the arm 20, about the axis 46, this movement in rotation being illustrated by arrow 74. The movement in rotation of the arm 44 about the axis 46 corresponds to a movement in translation of its end 50 relative to the pump, this movement in translation being directed along the axis X and being represented by arrow 76. During this movement in translation, the end 50 drives the pump 14 in translation along the axis X. After this movement, the pump 14 finds itself in its dispensing position, shown in dashed lines in FIG. 4, in which position the upstream portion 24 of the pump has slid towards the downstream portion 26, in such a manner as to suck in liquid that is subsequently dispensed through the orifice 32, e.g. into the nose of the user. Once the pump 14 is in the dispensing position, the pump 14 cannot move any further in translation, and the user, by continuing to press on the zone 40, causes a greater force to be exerted by the end 50 against the abutment 54, so that the end 50 can force its way past the abutment 54. As a result, the abutment 52 on the arm 44, which was driving the abutment 54, as shown in FIG. 3, no longer co-operates with the abutment 54, so that the pump is free to return to the rest position, under drive from return means that are internal to the pump 14, whereas the main arm 20 is held pressed by the user. As a result of this declutching of the pump, and while the pump is returning to its rest position, said pump can suck in liquid and not air because, when the device 10 is in the head-down position, the liquid is situated beside the outlet segment 28 of the reservoir 12. Thus, before the user puts the device back into the head-up position, it has been possible for the pump to suck in liquid, thereby preventing the pump from being de-primed by sucking in air.

After declutching has taken place via the intermediate arm 44, with the user having pushed in the main arm 20 to the fullest extent, and with the metered quantity of liquid having been dispensed from the device, the user ceases to press on the intermediate arm, and puts the device 10 back into the head-up position. The user ceasing to exert pressure on the press zone 40 releases the main arm 20 that can thus resume its initial position, by means of the return means 42 bearing against the container 12 or against the link ring 16, as shown in FIG. 3. In parallel, the intermediate arm 44 can also resume its initial position, under the effect of the return force exerted by the means 58, bearing against the main arm 20, as can be seen in FIG. 2. In resuming this initial position, the intermediate arm 44 goes past the abutment 54 in the other direction, in such a manner as to resume its rest position shown in FIG. 3, in which position the abutment 52 of the arm 44 is in position for co-operating with the abutment 54 and thus for driving the pump 14.

It can be understood that, by means, in particular, of the intermediate arm 44, the force F to be exerted by the user on the device 10, in order to actuate the pump 14, is lower.

As can be observed, the optimum configuration of the device 10 depends on certain parameters that vary as a function of type of device. Thus, it is possible, for example, to vary the length of the main arm 20, the length of the intermediate arm 44, the angle α (alpha) of the main arm 20 relative to the axis X of the device, the distance OA between the two pivot axes 34, 46, the horizontal position of the point C, i.e. of the end 50 of the intermediate arm 44, the force P or the stroke to be applied to the pump in order to actuate it, etc.

In order to determine the optimum configuration, the inventors have expressed the force F to be exerted by the user on the device 10 for the purpose of activating the pump. This force is expressed by the following equation:

$$F = \frac{P*(OA)*\sin\left\{90+\alpha-\mathrm{Arccos}\left[\frac{(Xc-(OA*\sin\alpha))}{(AC)}\right]\right\}}{\sin\left\{\mathrm{Arccos}\left[\frac{Xc-(OA*\sin\alpha)}{(AC)}\right]\right\}*(OB)*\cos\alpha}$$

where:

P designates the force for activating the pump;

OA designates the distance between the axis 34 and the axis 46;

α (alpha) corresponds to the angle of the main arm 20 relative to the axis X;

$X_c$ designates the horizontal position of the point C, relative to the axis Y, said point C corresponding to the point of contact between the intermediate arm 44 and the link ring 16;

AC designates the length of the intermediate arm 44; and

OB designates the distance between the main axis 44 and the press zone 40 of the main arm 20.

In order to determine for which value of one or more of these parameters the force exerted by the user on the press zone 40 is at a minimum, it is possible to derive the above expression of the force F relative to one or more parameters of the equation, and to solve one or more equations corresponding to the situation when the derivatives are equal to zero.

In one embodiment, the following values are considered as being particularly advantageous for minimizing the force to be applied by the user on the press zone 40:

OA=10.8 millimeters (mm)

OB=45 mm

AC=15 mm

α (alpha)=10°

$X_c$=11.22 mm

Figure 6:
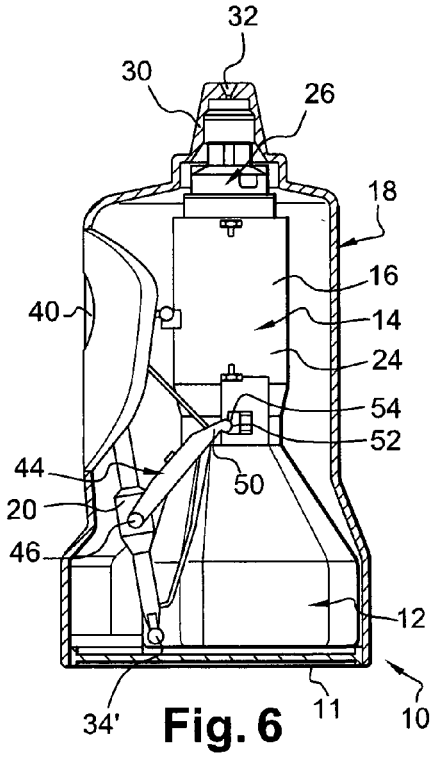
FIG. 6 is a view analogous to FIG. 3, showing another embodiment of a device.

In another embodiment, shown in FIG. 6, the main axis 34' of the main arm 20 is provided in the vicinity of the end-wall 11 of the device 10, and the press zone 40 is provided in the vicinity of the opposite end, namely the dispenser head 30. Thus, the user presses on the top portion of the casing 18. Such an arrangement may be more practical for the user. It can be understood that operation of this embodiment is particularly close to operation of the embodiment shown in FIG. 1.

It should be noted that the invention is not limited to the above-described embodiments.

In particular, the disabling means 60, 62, 64 are not necessarily provided on the device.

Similarly, the declutching means are optional. Thus, instead of providing declutching of the device by the end 50 of the intermediate arm 44 forcing its way past the abutment 54, it is possible to make provision for the end 50 to be continuously in abutment against the abutment 54 on the link ring 16, so that the pump 14 resumes its rest position once the user releases the main arm 20. In this configuration, the return means 42, 58 for the main arm 20 are no longer essential, because the intermediate arm 44 and the main arm 20 are urged back into the rest position by return means internal to the pump 14, bringing said pump back into the rest position.

In addition, it should be noted that the arms 20 and 44 are referred to as the "main arm" and as the "intermediate arm" to make it simpler to understand the description, but the use of such terms does not mean that the arm 20 is necessarily longer or more rigid than the arm 44. In other words, the arm 20 could be referred to as the "first arm" and the arm 44 could be referred to as the "second arm".

It should also be noted that the pump 14 described by way of example is designed to dispense liquid, but it is possible for the pump to be a pump for dispensing gas, or indeed a pump for sucking in external fluid.

Among the advantages of the invention, it should be noted that the use of an arm that is activated transversely is advantageous as regards maximizing the compactness of the device in the axial direction.

Among the advantages of the above-described declutching means, it should be noted that the declutching guarantees that a metered quantity has been fully dispensed, and thereby avoids the user releasing the arm 20 before the metered quantity has been dispensed in full. Thus, the declutching guarantees, in simple manner, that the metered quantity is delivered, without over-complicating the mechanism of the device 10.

It should be noted that although combining the declutching means and the disabling means makes it possible to avoid any de-priming of the pump 14, they could be used independently from each other.

It should also be noted that the use of the disabling means or of the declutching means is particularly advantageous when a pump 14 is used without a dip tube.

What is claimed is:

1. A fluid dispenser device for dispensing fluid, wherein said fluid dispenser device comprises:

a pump for dispensing the fluid;

a dispensing head disposed toward a first axial end of the device;

a main arm mounted to pivot on the device about a main axis disposed in the vicinity of the dispensing head and toward the first axial end of the device, the main arm provided with a press zone on which the user exerts pressure in order to actuate the pump, said press zone being provided toward a second axial end of the device, the second axial end of the device being opposite the first axial end, with the main axis being disposed between the dispensing head and the press zone;

an intermediate arm mounted to pivot on the main arm about an intermediate axis, the intermediate axis being disposed on the main arm between the press zone and the main axis, thus generating a lever effect that reduces the force that needs to be exerted by the user on the press zone for the purpose of actuating the pump, and the intermediate arm being configured to transmit the movement of the press zone to the pump; and a declutching mechanism operating in such a manner that the pressure exerted by the user causes the pump to return to its rest position after said pump has moved into a dispensing position.

2. A device according to claim 1, having two ends, the main axis being provided in the vicinity of one of the ends and the press zone being provided in the vicinity of the opposite end.

3. A device according to claim 1, wherein the intermediate arm has a free end opposite from its pivot axis, this free end co-operating with an abutment constrained to move with the pump, the abutment being arranged in such a manner that the pivoting of the intermediate arm causes the pump to be moved into a fluid dispensing position.

4. A device according to claim 1, wherein the intermediate axis is mounted on the main arm at a distance relative to the main axis that is less than two-thirds of the distance between the main axis and the press zone.

5. A device according to claim 1, wherein the declutching mechanism comprises an abutment past which the intermediate arm forces its way once the pump is in the dispensing position.

6. A device according to claim 1, further comprising a dispenser head and that can take up a head-up position or a head-down position, the device being designed to dispense liquid when it is in the head-down position, the device being provided with a disabling mechanism for disabling the device when it is in the head-up position.

7. A device according to claim 6, wherein the disabling mechanism comprises a ball that can take up a disabling position and that, under the effect of gravity, can take up an enabling position.

8. A device according to claim 2, wherein the intermediate arm has a free end opposite from its pivot axis, this free end co-operating with an abutment constrained to move with the pump, the abutment being arranged in such a manner that the pivoting of the intermediate arm causes the pump to be moved into a fluid dispensing position.

* * * * *